United States Patent [19]

Hirokoh et al.

[11] Patent Number: 4,541,914

[45] Date of Patent: Sep. 17, 1985

[54] PROCESS FOR CONVERTING COAL

[75] Inventors: Nobuyoshi Hirokoh, Tokyo; Yoichi Kageyama, Isehara; Yukio Nakako, Takarazuka; Tetsuo Matsumura, Kobe, all of Japan

[73] Assignees: Mitsubishi Chemical Industries Ltd., Tokyo; Kabushiki Kaisha Kobe Seikosho, Kobe; Idemitsu Kosan Company Limited, Tokyo; Asia Oil Company Limited, Tokyo; Nippon Brown Coal Liquefaction Co., Ltd., Tokyo, all of Japan

[21] Appl. No.: 484,311

[22] Filed: Apr. 12, 1983

[30] Foreign Application Priority Data

Apr. 19, 1982 [JP] Japan ..... 57-64973

[51] Int. Cl.[4] ..... C10G 1/08

[52] U.S. Cl. ..... 208/10

[58] Field of Search ..... 208/10

[56] References Cited

U.S. PATENT DOCUMENTS

| | | | |
|---|---|---|---|
| 3,488,279 | 1/1970 | Schulman | 208/10 |
| 3,679,573 | 7/1972 | Johnson | 208/10 |
| 3,700,584 | 10/1972 | Johanson et al. | 208/10 |
| 4,045,329 | 8/1977 | Johanson et al. | 208/10 |
| 4,102,775 | 7/1978 | Quarderer et al. | 208/10 |
| 4,172,024 | 10/1979 | Simone et al. | 208/10 |
| 4,295,954 | 10/1981 | Mitchell | 208/10 |
| 4,339,329 | 7/1982 | Kageyama et al. | 208/10 |
| 4,344,838 | 8/1982 | Mitchell | 208/10 |
| 4,379,744 | 4/1983 | Rosenthal et al. | 208/10 |
| 4,411,767 | 10/1983 | Garg | 208/10 |

*Primary Examiner*—D. E. Gantz
*Assistant Examiner*—William G. Wright
*Attorney, Agent, or Firm*—Oblon, Fisher, Spivak, McClelland & Maier

[57] ABSTRACT

A process for converting coal, comprising, subjecting a slurry composed essentially of coal, a hydrocarbon solvent and a hydrogenation catalyst to primary hydrogenation to liquify the coal, separating the ash content of said coal from the reaction product thereby obtaining a liquified product, subjecting at least a portion of the liquified product to secondary hydrogenation in the presence of a hydrogenation catalyst thereby converting the liquified product to light oil product, the secondary hydrogenation step being a point of supply of hydrogenation catalyst to the coal conversion system, separating the hydrogenation catalyst from the reaction product of the secondary hydrogenation step, and returning said separated hydrogenation catalyst to the primary hydrogenation step where it is used as the catalyst for primary hydrogenation of said slurry.

7 Claims, No Drawings

PROCESS FOR CONVERTING COAL

The present invention relates to a process for obtaining light oil by liquefying coal, particularly a non-caking coal such as bituminous coal, brown coal or lignite. More particularly, it relates to an improved process wherein light oil is obtained from such coal by two step hydrogenation.

In general, when coal is heated together with a hydrocarbon solvent under hydrogen pressure, condensed ring aromatic compounds constituting the coal will undergo hydrogenolysis, whereby the solid coal will be converted to a form which is soluble in a solvent. Then, insoluble coal and the ash content of the coal which remain as insoluble matter in the solvent without undergoing hydrogenolysis, are separated by a separation process such as filtration, and the solvent is then distilled off to obtain a liquefied product which is called a solvent refined coal. This solvent refined coal has been developed primarily as a non-polluting fuel coal. However, various processes are being studied for the production of light oil such as naphtha or gasoline by subjecting the solvent refined coal to treatment such as hydrogenolysis. Among the various coals, bituminous coal, brown coal and lignite constitute at least 40% of the estimated amount of coal deposits in the world and thus they are available abundantly and at low costs. However, they have a low rank of coalification and therefore their demand is rather limited, i.e. they are presently used only as fuel. Under the circumstances, it is extremely important to develop an efficient process for modifying or converting brown coal, lignite and the like to light oils which have a wide range of applications.

A research for the production of light oils from coal was extensively conducted in Germany prior to the second world war, then declined as the petroleum era started, and recently has also regained importance as oil prices have increased. However, an economically feasible process has not yet been developed. Various processes so far proposed are classified generally into a single step process and a two step process. The single step process is a process in which hydrogenation is carried out in a single step in the presence of a fluidized bed catalyst at a high temperature under high pressure. However, this process has various problems such that the control of the reaction is rather difficult, the selectivity to obtain a desired oil fraction is rather low, the effective life of the catalyst is rather short and the apparatus is inevitably expensive to meet the requirements for operation at a high temperature under high pressure condition. On the other hand, the two step process is a process in which a primary hydrogenation is carried out in the presence or absence of a fluidized bed catalyst at a relatively high temperature under high pressure in a relatively short period of time until the coal is liquefied or a solvent refined coal is obtained and after removing the ash content, the catalysts, the solvent, and the like are removed from the hydrogenated product. A secondary hydrogenation is carried out under relatively mild conditions with use of a fixed bed catalyst, whereby the control of the reaction is easier as compared with the single step process, the effective life of the hydrogenation catalyst for the second hydrogenation can be prolonged by the removal of the substantial amounts of the ash content and heavy metals, and the selectivity for the desired product can be improved.

These advantages outweigh the disadvantage of the process being complex.

However, in the conventional two step processes, the above-mentioned advantages are not necessarily adequate, particularly the effective life of the hydrogenation catalyst for the secondary hydrogenation is not adequately improved, and as a whole, the secondary hydrogenation catalyst are not yet adequately satisfactory for application in an industrial scale.

The present inventors have conducted extensive research to overcome the difficulties inherent to the conventional processes and to provide an economically feasible process for conversion of coal, and as a result, have found that certain fluidized bed catalysts including those developed earlier by the present inventors exhibit superior not only in the primary hydrogenation, but also in the secondary hydrogenation in the above-mentioned two step process, while the catalyst used in the primary hydrogenation degrades in catalytic activity when used in the secondary hydrogenation reaction, the catalyst used in the secondary hydrogenation can effectively be used in the primary hydrogenation. Moreover while in the conventional processes, the separation of the catalyst from the reaction product of the secondary hydrogenation must be satisfactorily done in order to minimize the loss of hydrocarbons, it is rather advantageous that the catalyst to be sent to the primary hydrogenation is accompanied by a substantial amount of relatively heavy reaction products. On the basis of these discoveries, it is now possible to provide a two step conversion process whereby light oils can industrially advantageously be obtained from coal.

Accordingly, it is an object of the present invention to provide an industrially feasible process for the conversion of coal.

Another object of the present invention is to provide an industrially advantageous improvement of the two step hydrogenation process designed primarily for the production of a solvent refined coal and light oils.

These objects of the present invention can readily be attained by a process for converting coal which comprises subjecting a slurry composed essentially of coal, a hydrocarbon solvent and a hydrogenation catalyst to a primary hydrogenation treatment to liquefy the coal, separating the ash content from the reaction product to obtain a liquefied product, and subjecting at least a portion of the liquefied product to a secondary hydrogenation treatment in the presence of a hydrogenation catalyst to convert the liquefied product to light oil. The process is further characterized by supplying a hydrogenation catalyst to the secondary hydrogenation treatment step, separating the hydrogenation catalyst from the reaction product of the secondary hydrogenation treatment and using the separated hydrogenation catalyst as the catalyst for the primary hydrogenation treatment.

The hydrogenation catalyst to be used in the present invention is, in general, a fluidized bed catalyst which is catalytically active in both steps of the primary and secondary hydrogenation reactions. It may be selected from various types of the conventional hydrogenation catalysts such as iron oxide, iron sulfide, converter dust, red mud, iron ore or Ni-Mo type catalysts. However, for the purpose of the preferred embodiment of the present invention wherein at the time of separating the ash content after the primary hydrogenation, the catalyst is also separated, a relatively inexpensive fine powder catalyst or iron type such as iron oxide, iron sulfide, red mud, converter dust or iron ore is preferably used. Particularly preferred is a finely pulverized iron ore proposed earlier by the present inventors, which most suitably matches the entire process of the present invention to bring about a remarkable economical advantage. That is, in general, the smaller the particle size of the catalyst, the larger the surface area of the catalyst becomes and consequently the higher the catalytic activity per unit weight of the catalyst becomes. In the mechanical pulverization treatment of the iron ore, the pulverized iron ore, having a smaller particle size; has a higher activity even when the catalytic activity is compared on the basis of the same unit surface area. It is believed that a fresh catalytically active surface having an extremely high catalytic activity is formed on the fractured surface by the mechanical pulverization of the iron ore.

Such a catalyst, when once used for the primary hydrogenation reaction, is no longer adequate for use in the secondary hydrogenation reaction. However, if the catalyst is first used for the secondary hydrogenation reaction and then used for the primary hydrogenation reaction, it exhibits an adequate catalytic activity not only in the secondary hydrogenation reaction but also in the primary hydrogenation reaction, with the result that the coal exhibits a high solubility in the solvent and yet the degree of the hydrogenolysis can be controlled to a lesser extent so that an excessive hydrogenation reaction can be avoided and the hydrogen consumption relative to the desired product can be minimized. Thus, it has been found possible to realize an improved two step hydrogenation reaction.

Among the various iron ores, hematite or limonite type is particularly suitable. Particularly high activity is obtainable when it has a particle size of at most 40 $\mu$m and it is preferred that at least 50% by weight of the particles have a particle size of at most 15 $\mu$m. With use of a more finely pulverized iron ore, the catalytic activity may further be improved and a lesser amount of the catalyst may be required. In such a case, however, the cost for the pulverization and the convenience for handling should be taken into account.

The pulverized iron ore having such a particle size may readily be obtained by directly pulverizing the iron ore by means of a pulverizer such as a ball mill or a roller mill, or by pulverizing in a wet system with use of a solvent.

The primary hydrogenation treatment is not a special one and may be carried out under the reaction conditions commonly used for the primary hydrogenation in the conventional two step conversion process. Specifically, it is carried out at a temperature within a range of from 350° to 500° C., preferably from 380° to 450° C., under hydrogen partial pressure within a range of from 20 to 250 kg/cm$^2$G, preferably from 75 to 200 kg/cm$^2$G, for a reaction time of from 5 to 120 minutes. When the reaction conditions are maintained within these ranges, a desired heavy liquefied product can advantageously be obtained from the raw material coal.

Theoretically, any kind of coal may be used as the raw material. Practically, however, it is advantageous to use a coal having a relatively low rank of coalification, such as bituminous coal, brown coal or lignite as mentioned above. The coal is usually pulverized to a particle size of about 0.1 mm. The coal powder may directly be supplied to the reaction zone, or preferably, it is mixed with a hydrocarbon solvent and/or a catalyst before being supplied to the reaction zone. As the solvent, a petroleum type hydrocarbon compound may be used, but, a coal type solvent is preferred. Various solvents such as anthracene oil or creosote oil may be used. It is preferred to use a solvent having a boiling point within a range of from 150° to 450° C. at the atmospheric pressure. After the reaction, the solvent is recovered and reused. However, it may happen that during the reaction, the solvent undergoes hydrogenolysis and changes to a light oil component such as naphtha, whereupon the solvent balance in the entire process will be broken. However, in the present invention, it is possible to obtain suitable distillation fractions from the hydrogenation products of the primary and/or secondary hydrogenation reaction and use them as a solvent to be recycled to the primary hydrogenation reaction. Further, by the combination of such steps, it is possible to omit the use of excessive materials, whereby the economy of the process for the conversion of the coal can be improved according to the present invention. Thus, it should be understood that the hydrocarbon solvent to be used in the present invention includes distillation fractions having a boiling point within the above-mentioned range which are produced by the process. The amount of the solvent to be supplied to the primary reaction is selected within a range of from 1.4 to 3.5, preferably from 1.5 to 2.5 times the relative weight of the coal raw material with its ash and moisture content eliminated. The primary hydrogenation reaction is carried out as a fluidized catalyst bed reaction. With respect to the amount of hydrogen gas, supplied the manner of supply, the manner of maintaining the fluidized bed and the apparatus, various ideas and manners which are commonly known in the field of liquefaction of coal and chemical industry, may be employed. From the reaction product, at least solid components such as the catalyst and the ash content are removed. Further, in some cases, it is permissible to remove, by a conventional method such as distillation, products which have already adequately been hydrogenated to a level corresponding to light oil fractions, and/or at least a portion of fractions which are useful as various carbon materials and which are soluble in quinoline and insoluble in benzene or hexane, and/or distillation fractions which are useful as a solvent to be recycled to the primary reaction as mentioned above.

A portion or all of the reaction product thus obtained by the liquefaction of coal, preferably the reaction product composed mainly of heavy oil components, such as the solvent refined coal, is then subjected to the secondary hydrogenation reaction. The reaction conditions may be varied depending upon the desired composition for the final oil fractions. The fluidized conditions for the catalyst may be maintained usually at a temperature within a range of from 350° to 500° C. under hydrogen pressure within a range of from 20 to 350 kg/cm2. In the present invention, it is important to supply a fresh fluidized bed catalyst to the secondary hydrogenation reaction. It has been found that the poisoning of the catalyst in this step is not so serious and when the catalyst used in this step is recycled for use in the above-mentioned primary hydrogenation reaction, it exhibits adequate catalytic activity in the primary hydrogenation reaction. Accordingly, the catalyst to be used in this step is the same as the one used in the primary hydrogenation reaction. The reaction product thus obtained is subjected to a conventional solid-liquid separation to remove the catalyst and if necessary, subjected to fractional distillation to obtain desired fractions, whereby oil components composed substantially of light oils can be obtained in good yield and at high conversion. The separated catalyst is recycled to the primary hydrogenation step by itself or as a catalyst stream together with at least a part of the heavy reaction products. It is advantageous to separate and recycle the catalyst in the form of a catalyst stream, i.e. together with the heavy reaction products, since it is thereby possible not only to facilitate and simplify the separation and transportation of the catalyst but also to permit the heavy reaction products to act as a hydrogen donor in the primary hydrogenation reaction system whereby the liquefaction of coal is further facilitated.

The amount of the catalyst used in the secondary hydrogenation reaction may be optionally selected depending upon the strength of the catalytic activity of the catalyst and the amount and the composition of the liquefied product subjected to the hydrogenation reaction. For instance, in the case where finely pulverized iron ore is used, the amount of the catalyst is selected within the range of from 0.5 to 20 parts by weight relative to 100 parts by weight of the liquefied reaction product to be subjected to the hydrogenation reaction.

In another preferred embodiment of the present invention, fine particles of a molybdenum compound may be used as a catalyst. For instance, finely powdered molybdenum oxide or ammonium molybdate, or an organic or aqueous solution of ammonium molybdate may be added to the feed material for the secondary hydrogenation reaction or may be supplied to the secondary hydrogenation reaction zone.

In general, molybdenum catalysts are more expensive than iron type catalysts. However, if they are used in the form of fine particles, they may be sufficiently effective even in a small amount and may be industrially advantageously employed in an economically feasible manner. Further, when a molybdenum compound is supplied in a liquid form, it will be dispersed in the reaction zone in the form of fine solid particles which are effective as the catalyst. It is preferred that sulfur or a sulfur compound is incorporated with the molybdenum compound to modify the latter with sulfur. Sulfur is added preferably in an amount of at least 2.4 times the amount of molybdenum in atomic ratio. The amount of the catalyst to be supplied to the reaction zone is usually from 0.01 to 10.0% by weight, preferably from 0.02 to 1.0% by weight, as molybdenum, based on the amount of the feed material.

After the reaction, the separated catalyst or catalyst stream is recycled to the primary hydrogenation reactor. However, at the time of the recycling, if necessary, a portion of the catalyst may be recycled to the secondary hydrogenation reaction zone for the purpose of increasing, together with an additional amount of a fresh catalyst, the total amount of the catalyst in the secondary reaction zone, or a fresh catalysts may be added to the catalyst to be recycled to the primary hydrogenation reaction zone to increase the total amount of the catalyst in the primary reaction zone.

Further, a gas component containing unreacted hydrogen and $CH_4$ in the reaction products of the primary and secondary hydrogenation reaction may be separated and used as a fuel or may be used as a starting material for the production of hydrogen to be used for the hydrogenation reaction. The middle to heavy oil fractions in the reaction products of the two hydrogenation reactions will be divided, a portion of which will be used as a solvent for slurrying the coal raw material or as a medium for transporting the catalyst or catalyst stream which has been separated from the reaction product of the secondary hydrogenation and which is to be recycled to the primary hydrogenation reaction. Particularly, it is advantageous to recycle the heavy oil fractions to the same or other hydrogenation reaction zone to convert the heavy fractions into light oil fractions.

In the foregoing, the process has been described with reference to an embodiment where the secondary hydrogenation is carried out in a fluidized bed system. However, the present invention is not limited to this specific embodiment. For instance, the present invention may be applied to a system where a portion of the primary hydrogenation reaction product (which may or may not be completely deashed or partially deashed by means of, e.g., a liquid cyclone or which may be separated into a heavy oil component containing ash and a relatively light oil component, the light oil component being used as the part of the primary hydrogenation reaction product) is combined with a fresh catalyst and subjected to the secondary hydrogenation in a fluidized bed system, while at least portion of the remainder of the primary hydrogenation reaction product is, if required after further deashing, subjected to the secondary hydrogenation in a fixed bed system. In this case, it is most preferred that a portion having a lesser ash content divided by means of e.g. a liquid cyclone, is subjected to the secondary hydrogenation in the fluidized bed system of the present invention, while a portion having a concentrated ash content is further deashed and subjected to the second hydrogenation in a fixed bed system, whereby the load for deashing and the load for the second hydrogenation reaction can be reduced as a whole. In either case, the catalyst is separated, preferably together with a heavy oil component, from the reaction product of the secondary hydrogenation by means of a fluidized bed and separated catalyst is recycled to the primary hydrogenation reaction in accordance with the essential feature of the present invention.

Now, the present invention will be described in further detail with reference to Example. However, it should be understood that the present invention is by no means restricted to this specific Example. In the Example, "parts" means "parts by weight".

EXAMPLE

A feed slurry was prepared by mixing 100 parts (by weight excluding ash and moisture) of coal powder obtained by pulverizing brown coal produced in Victoria, Australia followed by water removal and 200 parts of a hydrocarbon solvent having a boiling point within a range of from 180° to 420° C.

On the other hand, a catalyst slurry was prepared by adding to 200 parts of the above-mentioned hydrocarbon solvent, 22.7 parts of a recycled catalyst stream which was separated from the reaction product of the below-mentioned secondary hydrogenation and which contained a portion of heavy reaction products and 2.4 parts of finely pulverized iron ore catalyst.

The feed slurry was combined with the catalyst slurry and the mixture was fed to a primary hydrogenation reaction zone. The hydrogenation reaction was carried out at 425° C. under hydrogen pressure of 200 $kg/cm^2$ under fluidized conditions for one hour. After removing a gas component by means of a gas-liquid separator, the reaction product was subjected to distillation, whereby 83.1 parts of a high boiling point fraction having a boiling point of 180° C. or higher was obtained. A low boiling point fraction having a boiling point lower than the high boiling point fraction was obtained partly as a light oil product and a portion of which was used as a solvent for the above slurries.

Further, the heavy reaction products were subjected to deashing to remove solid components such as ash and the catalyst, whereby 47.2 parts of a heavy liquefied reaction product was obtained. To this reaction product, 2.4 parts of finely pulverized iron ore hematite having an average particle size of 3.5 μm (substantially all particles had a size of not greater than 10 μm) was added, and the mixture was subjected to a secondary hydrogenation reaction at 460° C., under hydrogen pressure of 230 kg/cm$^2$ for 2 hours under a fluidized condition. After the reaction, a gas component was removed from the reaction product, and the reaction product was fractionated by distillation into a light oil fraction having a boiling point within a range of from 180° to 420° C. and a catalyst stream containing a fraction having a boiling point higher than the light oil fraction. A portion of the catalyst stream containing substantially all of the catalyst together with a portion of the high boiling point fraction was used as the catalyst stream to be recycled to the above-mentioned primary hydrogenation reaction zone. The rest of the high boiling point fraction was used as a solvent for the above-mentioned slurries.

Thus, a total of 34.6 parts of the light oil fractions were obtained from the primary and secondary hydrogenation reaction products. Further, it was found that the above-mentioned finely to powdered iron ore, which was initially developed as a catalyst for the primary hydrongenation reaction, exhibited adequate catalytic activity in the secondary hydrogenation reaction and that said catalyst, once used for the secondary hydrogenation reaction still had adequate catalytic activity when used in the primary hydrogenation reaction. The catalyst after the primary hydrogenation reaction was extensively poisoned by metal components, alkali components or preasphaltenes or high molecular weight asphaltenes contained in the feed coal or carbides, and it was not useful for further catalyzing additional hydrogenation reactions.

We claim:

1. A process for preparing light oil from coal by two step hydrogenation, which comprises:

(a) forming a slurry composed essentially of coal, a hydrocarbon solvent and a hydrogenation catalyst which is the catalyst stream from step (h) below:

(b) subjecting the slurry to a primary fluidized-bed hydrogenation treatment to obtain a liquefied product;

(c) withdrawing the liquefied product together with the hydrogenation catalyst from the primary hydrogenation treatment step;

(d) subsequently, separating the ash content and the hydrogenation catalyst from the liquefied product;

(e) subjecting at least a portion of the liquefied product to a secondary fluidized-bed hydrogenation treatment to convert the liquefied product to light oil while feeding fresh hydrogenation catalyst to the secondary hydrogenation treatment step, said fresh catalyst being a fine powder of a hematite or limonite type iron ore having a particle size of at most 40 μm;

(f) withdrawing the reaction product of the secondary hydrogenation treatment together with the hydrogenation catalyst;

(g) separating the hydrogenation catalyst in the form of a catalyst stream composed essentially of the hydrogenation catalyst and a heavier distillate of the reaction product from the material withdrawn in step (f); and (h) circulating said catalyst stream to step a) to provide hydrogenation catalyst for the primary fluidized-bed hydrogenation treatment.

2. The process according to claim 1 wherein the coal is bituminous coal, brown coal and/or lignite.

3. The process according to claim 1, wherein said primary hydrogenation is conducted at a temperature of 350° to 500° C. under a hydrogen partial pressure of 20 to 250 kg/cm$^2$G for a reaction time of from 5 to 120 minutes.

4. The process according to claim 1, wherein the amount of said solvent supplied to the primary hydrogenation step is within the range of from 1.4 to 3.5 times the weight of the coal raw material less its ash and moisture content.

5. The process according to claim 1, wherein the secondary hydrogenation treatment is conducted at a temperature of from 350° to 500° C. under a hydrogen pressure of from 20 to 350 kg/cm$^2$.

6. The process according to claim 1, wherein the amount of said catalyst in the secondary hydrogenation step ranges from 0.5 to 20 parts by weight relative to 100 parts by weight of the liquefied reaction product.

7. The process according to claim 1, wherein said hydrogenation catalyst of the primary fluidized-bed hydrogenation treatment is a catalyst selected from the group consisting of iron oxide converter dust, and iron ore.

* * * * *